US008267221B2

(12) United States Patent
Chen

(10) Patent No.: US 8,267,221 B2
(45) Date of Patent: Sep. 18, 2012

(54) SOUND BOX AND ELECTRONIC DEVICE USING SAME

(75) Inventor: Hwang-Miaw Chen, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/086,347

(22) Filed: Apr. 13, 2011

(65) Prior Publication Data

US 2012/0160599 A1 Jun. 28, 2012

(30) Foreign Application Priority Data

Dec. 28, 2010 (CN) ..... 2010 1 0609138

(51) Int. Cl.
*H04R 1/02* (2006.01)

(52) U.S. Cl. ..... 181/199; 181/150; 381/333; 381/334; 381/335

(58) Field of Classification Search ..... 181/144, 181/145, 148, 150, 199; 381/150, 333, 334, 381/335, 345, 351
See application file for complete search history.

(56) References Cited

U.S. PATENT DOCUMENTS

| | | | | | |
|---|---|---|---|---|---|
| 4,926,487 | A * | 5/1990 | Yoshida et al. | ..... | 381/186 |
| 5,550,921 | A * | 8/1996 | Freadman | ..... | 381/300 |
| 5,818,942 | A * | 10/1998 | Freadman | ..... | 381/300 |
| 5,889,875 | A * | 3/1999 | Caron et al. | ..... | 381/338 |
| 6,141,428 | A * | 10/2000 | Narus | ..... | 381/338 |
| 6,298,942 | B1 * | 10/2001 | Schlatmann et al. | ..... | 181/144 |
| 6,925,188 | B1 * | 8/2005 | Markow et al. | ..... | 381/306 |
| 7,685,661 | B2 * | 3/2010 | Popilek et al. | ..... | 5/639 |
| 7,835,537 | B2 * | 11/2010 | Cheney | ..... | 381/337 |
| 2005/0207603 | A1 * | 9/2005 | Tse | ..... | 381/351 |
| 2007/0258611 | A1 * | 11/2007 | Li | ..... | 381/335 |
| 2008/0165991 | A1 * | 7/2008 | Shyu et al. | ..... | 381/160 |
| 2010/0158299 | A1 * | 6/2010 | Liu | ..... | 381/333 |
| 2010/0246874 | A1 * | 9/2010 | Chung et al. | ..... | 381/334 |

* cited by examiner

*Primary Examiner* — Jeremy Luks
(74) *Attorney, Agent, or Firm* — Altis Law Group, Inc.

(57) ABSTRACT

An exemplary sound box includes a box body and two speakers mounted in the box body. The box body defines two expanded portions and a connecting portion interconnecting the two expanded portions. Inner spaces of the connecting portion and the two expanded portions communicate with each other and cooperatively constitute a sound chamber of the sound box. Each of the expanded portions defines an opening therein. The two speakers are attached to the box body at the openings of the s two expanded portions respectively. This disclosure further discloses an electronic device configured with the sound box.

14 Claims, 4 Drawing Sheets

SOUND BOX AND ELECTRONIC DEVICE USING SAME

BACKGROUND

1. Technical Field

The present disclosure relates to sound boxes, and particularly to a sound box used in an electronic device.

2. Description of Related Art

Electronic devices such as notebook computers, game players, and music players are often configured with one or more sound boxes therein to provide audio output. Such sound box generally includes a box body, and a speaker mounted in the box body. The box body defines a sound chamber therein. The speaker is mounted in the sound chamber. Part of the sound generated by the speaker spreads out of the box body directly. Another part of the sound generated by the speaker resonates in the sound chamber, for promoting a low frequency sound quality of the sound box.

Generally, a sound box with a large size has a large sound chamber, and thus has good low frequency sound quality. However, the large sound box can not be used in miniaturized electronic devices such as small game players and music players. A sound box with a small size may have good adaptability in miniaturized electronic devices, but its small sound chamber typically has inferior capability to provide quality low frequency sound.

Accordingly, what is needed is a sound box which can overcome the limitations described.

DETAILED DESCRIPTION

Figure 1:
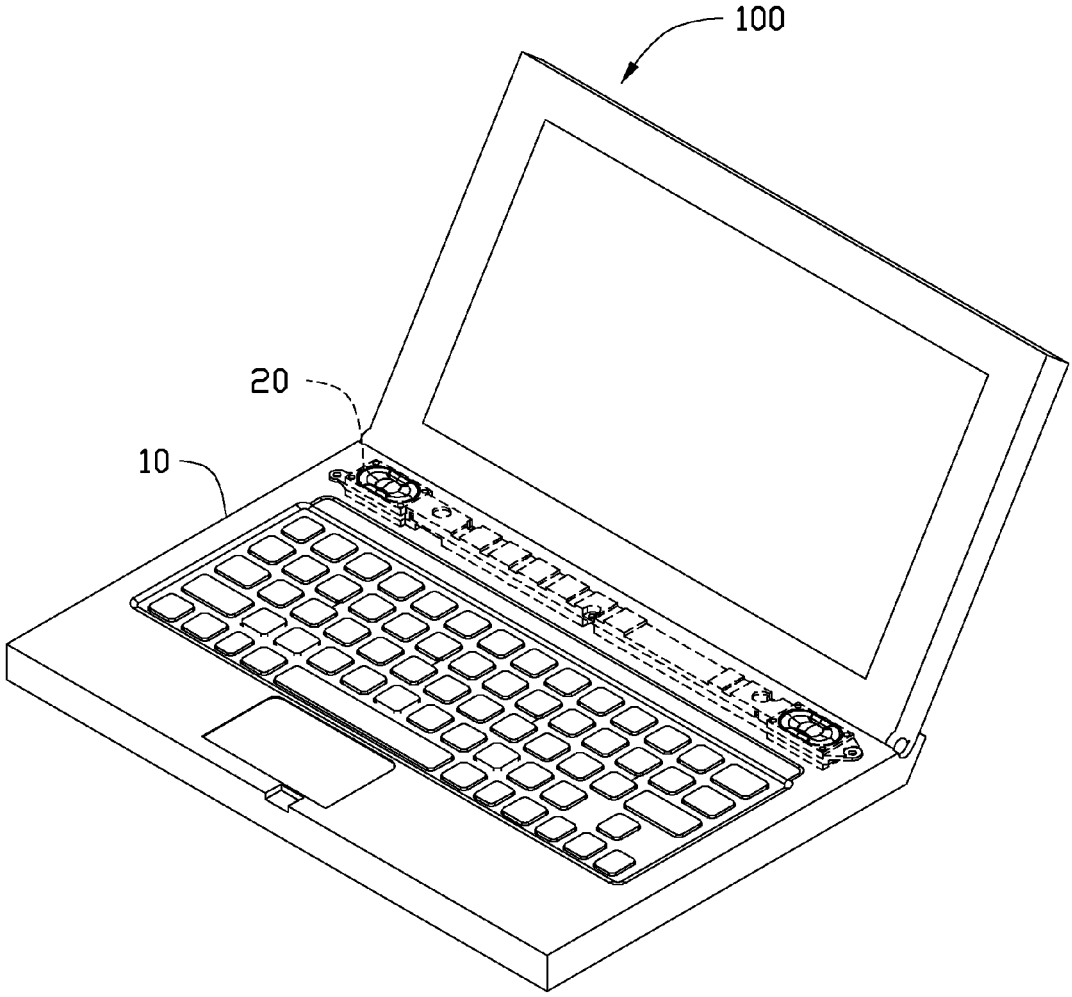
FIG. 1 is an isometric, assembled view of an electronic device in accordance with an exemplary embodiment of the present disclosure.

Referring to FIG. 1, an electronic device 100 according to an exemplary embodiment of the present disclosure is shown. In this embodiment, the electronic device 100 is a notebook computer. The electronic device 100 includes a shell 10, and a sound box 20 mounted in the shell 10.

Figure 2:
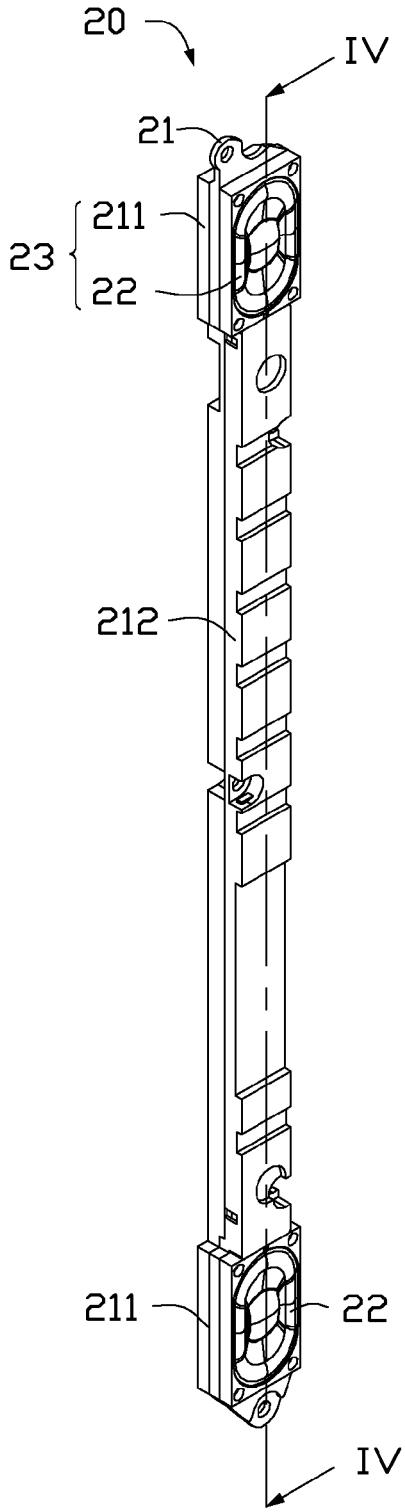
FIG. 2 is an isometric, assembled view of a sound box of the electronic device of FIG. 1.
Figure 3:
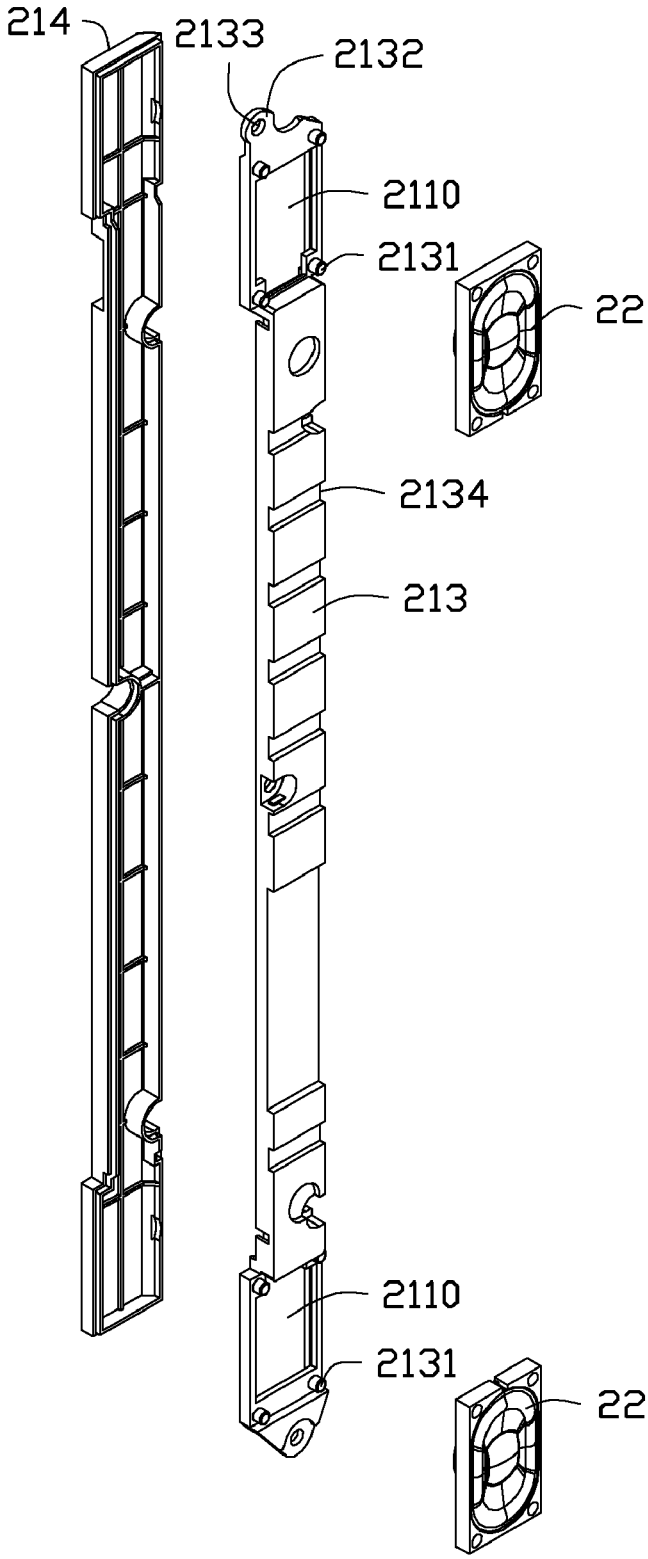
FIG. 3 is an exploded view of the sound box of FIG. 2.
Figure 4:
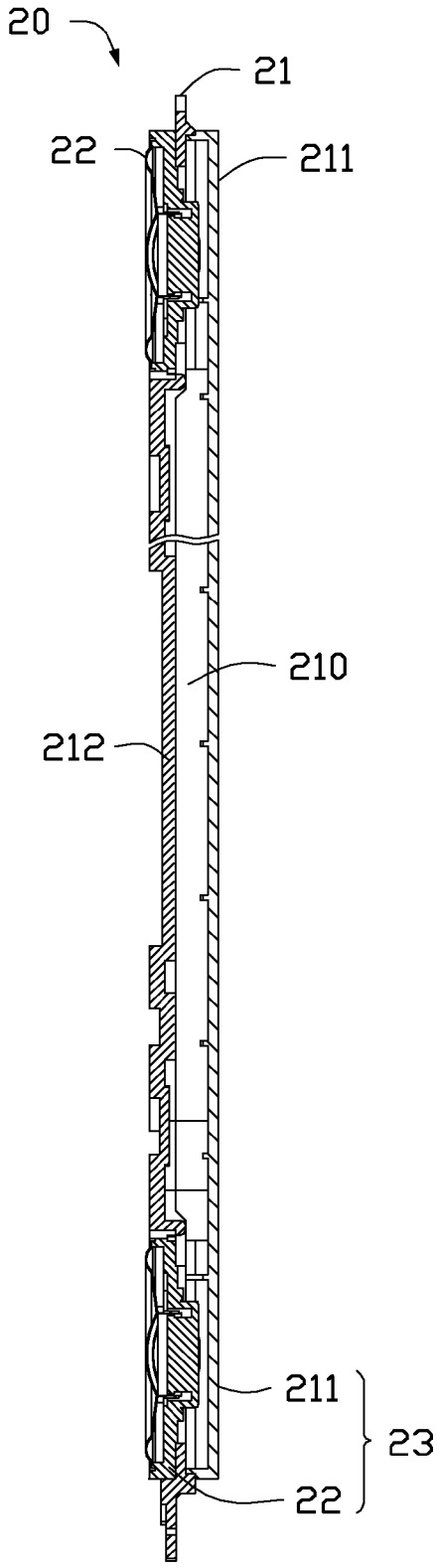
FIG. 4 is a cross section of the sound box of FIG. 2, taken along line IV-IV thereof.

Referring also to FIGS. 2 to 4, the sound box 20 is generally strip-shaped, and includes a box body 21 and two speakers 22 mounted in the box body 21. The box body 21 defines a strip-shaped sound chamber 210 therein. The box body 21 defines two expanded portions 211 at two opposite ends thereof, and a connecting portion 212 interconnecting the two expanded portions 211. The sound chamber 210 runs through the two expanded portions 211 and the connecting portion 212. Each of the expanded portions 211 defines an opening 2110 therein. The openings 2110 of the two expanded portions 211 communicate with the sound chamber 210. The two speakers 22 are respectively mounted on the two expanded portions 211, and are respectively aligned with the openings 2110 of the two expanded portion 211. The connecting portion 212 is strip-shaped. A transverse cross section area of the connecting portion 212 is less than that of each of the expanded portions 211. Inner spaces of the connecting portion 212 and the two expanded portions 211 cooperatively constitute the sound chamber 210.

In another aspect, the box body 21 includes a front cover 213 and a back cover 214 engaging with each other. The front cover 213 and the back cover 214 cooperatively constitute the expanded portions 211 and the connecting portion 212. The opening 2110 of each expanded portion 211 is defined in an end portion of the front cover 213. At the opening 2110, four positioning posts 2131 protrude from a front face of the front cover 213. The positioning posts 2131 surround the opening 2110, and are for mounting a corresponding speaker 22 over the opening 2110. Two mounting ears 2132 are respectively formed at two opposite ends of the front cover 213. Each of the mounting ears 2132 defines a mounting hole 2133 therein, for mounting the sound box 20 in the shell 10 of the electronic device 100. A front face of a main central body of the front cover 213 defines a plurality of recesses 2134 therein. The provision of the recesses 2134 reinforces the mechanical strength of the front cover 213. Furthermore, the recesses 2134 reduce the risk of the front cover 213 interfering with other components (not shown) in the shell 10 of the electronic device 100 nearby the sound boxes 20.

In the electronic device, the sound box 20 is provided with the two expanded portions 211 on which the speakers 22 are respectively mounted. Each of the expanded portions 211 together with the corresponding speaker 22 constitutes a small sound box 23.

The inner space of the connecting portion 212 communicates the inner spaces of the two small sound boxes 23 with each other. Therefore the inner space of each of the small sound boxes 23 is, in effect, expanded to encompass substantially all of the sound chamber 210 of the sound box 20. Compared with conventional sound boxes, each small sound box 23 has a small size but a large effective sound chamber. This commensurately endues the sound box 20 with good low frequency sound quality.

Furthermore, when the sound box 20 is mounted in the electronic device 100, the two expanded portions 211 of the sound box 20 are respectively mounted at two opposite sides of the shell 10 of electronic device 100, i.e. the right side and the left side, and the connecting portion 212 of the sound box 20 is received in a clearance (not shown) in the shell 10 between the right side and the left side. This not only enables the sound box 20 to generate stereophonic sound during operation of the electronic device 100, but also utilizes the adaptability of the sound box 20 for the electronic device 100. That is, the sound box 20 makes full use of the length of the inner space of the shell 10 of the electronic device 100 to provide optimum low frequency sound quality. All these advantages are particularly manifest when the electronic device 100 is a miniaturized device, and in miniaturized electronic devices such as small game players and music players.

It is to be understood, however, that even though numerous characteristics and advantages of the exemplary embodiments have been set forth in the foregoing description, together with details of the structures and functions of the embodiments, the disclosure is illustrative only, and that changes may be made in detail, especially in matters of shape, size, and arrangement of parts within the principles of the embodiments to the full extent indicated by the broad general meaning of the terms in which the appended claims are expressed.

What is claimed is:

1. A sound box comprising:

a box body comprising a front cover and a back cover engaging with each other, the front cover and the back cover cooperatively defining two expanded portions and a connecting portion interconnecting the two expanded portions, a front face of the front cover defining a plurality of recesses therein at the connecting portion, a projection being formed between every two adjacent recesses, a groove being defined in an inner surface of the connecting portion beneath the projection, inner spaces of the connecting portion and the two expanded portions communicating with each other and cooperatively constituting a sound chamber of the box body, each of the expanded portions defining an opening communicating with the sound chamber; and two speakers attached to the box body at the openings of the two expanded portions, respectively.

2. The sound box of claim 1, wherein a cross section area of the connecting portion is less than that of each of the expanded portions.

3. The sound box of claim 1, wherein the box body is strip-shaped, the two expanded portions are respectively located at two opposite end portions of the box body, and the connecting portion is strip-shaped and interconnects the two expanded portions.

4. The sound box of claim 1, wherein the openings are defined in the front cover.

5. The sound box of claim 4, wherein at each of the openings, four positioning posts protrude from a front face of the front cover, and the positioning posts surround the opening and mount the corresponding speaker over the opening.

6. The sound box of claim 1, wherein two mounting ears are respectively formed at two opposite ends of the front cover, and each of the mounting ears has a mounting hole defined therein.

7. An electronic device comprising:

a shell; and a sound box mounted in the shell, the sound box comprising:

a box body; and two speakers mounted in the box body, the box body comprising a front cover and a back cover engaging with each other, the front cover and the back cover cooperatively defining two expanded portions and a connecting portion interconnecting the two expanded portions, a front face of the front cover defining a plurality of recesses therein at the connecting portion, a projection being formed between every two adjacent recesses, a groove being defined in an inner surface of the connecting portion beneath the projection, inner spaces of the connecting portion and the two expanded portions communicating with each other and cooperatively constituting a sound chamber of the box body, each of the expanded portions defining an opening communicating with the sound chamber, the two speakers mounted on the two expanded portions at the openings thereof, respectively.

8. The electronic device of claim 7, wherein a cross section area of the connecting portion is less than that of each of the expanded portions.

9. The electronic device of claim 7, wherein the box body is strip-shaped, the two expanded portions are respectively located at two opposite end portions of the box body, and the connecting portion is strip-shaped and interconnects the two expanded portions.

10. The electronic device of claim 7, wherein the openings are defined in the front cover.

11. The electronic device of claim 10, wherein at each of the openings, four positioning posts protrude from a front face of the front cover, and the positioning posts surround the opening and mount the corresponding speaker over the opening.

12. The electronic device of claim 7, wherein two mounting ears are respectively formed at two opposite ends of the front cover, and each of the mounting ears has a mounting hole defined therein.

13. A sound box for stereophonic sound output, the sound box comprising:

a box body comprising a front cover and a back cover engaging with each other, the front cover and the back cover cooperatively defining two expanded portions and an intermediate connecting portion interconnecting the two expanded portions, a front face of the front cover defining a plurality of recesses therein at the connecting portion, a projection being formed between every two adjacent recesses, a groove being defined in an inner surface of the connecting portion beneath the projection, inner spaces of the connecting portion and the two expanded portions communicating with each other and cooperatively defining a sound chamber, each of the expanded portions defining an opening communicating with the sound chamber; and two speakers attached to the two expanded portions at the openings thereof, respectively, wherein one of the expanded portions and the corresponding speaker cooperatively define a first audio box, the other expanded portion and the corresponding speaker cooperatively define a second audio box, and the first and second audio boxes share the sound chamber.

14. The sound box of claim 13, wherein a cross section area of the connecting portion is less than that of each of the expanded portions.

* * * * *